US009464832B2

(12) United States Patent
Higashiiue

(10) Patent No.: US 9,464,832 B2
(45) Date of Patent: Oct. 11, 2016

(54) REFRIGERATION CYCLE DEVICE, EQUIPMENT, AND REFRIGERATION CYCLE METHOD

(75) Inventor: Shinya Higashiiue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 228 days.

(21) Appl. No.: 14/359,117

(22) PCT Filed: Nov. 30, 2011

(86) PCT No.: PCT/JP2011/077732

§ 371 (c)(1),
(2), (4) Date: May 19, 2014

(87) PCT Pub. No.: WO2013/080350

PCT Pub. Date: Jun. 6, 2013

(65) Prior Publication Data

US 2014/0331699 A1 Nov. 13, 2014

(51) Int. Cl.
*F25B 43/02* (2006.01)
*F25B 49/02* (2006.01)
(Continued)

(52) U.S. Cl.
CPC ..... *F25B 43/02* (2013.01); *F25B 31/004* (2013.01); *F25B 41/003* (2013.01); *F25B 49/02* (2013.01);
(Continued)

(58) Field of Classification Search
CPC ..... F25B 41/003; F25B 43/02; F25B 49/02; F25B 31/004; F25B 11/00; F25B 2341/0012; F25B 2400/13; F25B 2400/23; F25B 2600/2515; F25B 2700/1933; F25B 2700/2103
USPC ..... 62/84, 470, 190, 500
See application file for complete search history.

(56) References Cited

U.S. PATENT DOCUMENTS

2001/0025499 A1 10/2001 Takeuchi et al.
2004/0003608 A1* 1/2004 Takeuchi ..... B60H 1/3204 62/170

(Continued)

FOREIGN PATENT DOCUMENTS

EP 2 330 300 A1 6/2011
JP 6219658 A 1/1987

(Continued)

OTHER PUBLICATIONS

Thranslation of JP 2007163084 to Kusaka et al.*

(Continued)

*Primary Examiner* — Mohammad M Ali
(74) *Attorney, Agent, or Firm* — Posz Law Group, PLC

(57) ABSTRACT

A refrigeration cycle device includes: a compressor that constitutes a refrigeration cycle and compresses a supplied refrigerant; a refrigerant-retaining container that retains the refrigerant into which lubricating oil for the compressor is mixed, and which separates the gas refrigerant from the liquid refrigerant, and sends out the gas refrigerant to the compressor; a refrigerant conveying pump that conveys a fluid mixture including the liquid refrigerant and the lubricating oil retained in the refrigerant-retaining container; and an internal heat exchanger that changes the liquid refrigerant conveyed out from the refrigerant-retaining container by the refrigerant conveying pump to the gas refrigerant, and provides the compressor with the gas refrigerant together with the lubricating oil. Since the refrigerant conveying pump conveys the fluid mixture containing the liquid refrigerant and the lubricating oil retained in a refrigerant-retaining container, stable operation is possible.

15 Claims, 10 Drawing Sheets

(51) Int. Cl.

| | |
|---|---|
| ***F25B 41/00*** | (2006.01) |
| ***F25B 31/00*** | (2006.01) |
| *F25B 11/00* | (2006.01) |

(52) U.S. Cl.

CPC ..... *F25B 11/00* (2013.01); *F25B 2341/0012* (2013.01); *F25B 2400/13* (2013.01); *F25B 2400/23* (2013.01); *F25B 2600/2515* (2013.01); *F25B 2700/1933* (2013.01); *F25B 2700/2103* (2013.01)

(56) References Cited

U.S. PATENT DOCUMENTS

| | | | | |
|---|---|---|---|---|
| 2006/0266072 | A1* | 11/2006 | Takeuchi | F25B 40/00 62/500 |
| 2008/0034786 | A1* | 2/2008 | Oshitani | F25B 41/00 62/500 |
| 2010/0313582 | A1* | 12/2010 | Oh | F25B 9/008 62/115 |
| 2010/0319393 | A1* | 12/2010 | Ikegami | F25B 41/00 62/500 |
| 2011/0100038 | A1* | 5/2011 | Haussmann | B60H 1/3204 62/115 |

FOREIGN PATENT DOCUMENTS

| | | | |
|---|---|---|---|
| JP | 63-201960 | U | 12/1988 |
| JP | 08-005185 | A | 1/1996 |
| JP | 2002-349978 | A | 12/2002 |
| JP | 2007-163084 | A | 6/2007 |
| JP | 2010-185406 | A | 8/2010 |
| JP | 2011-127777 | A | 6/2011 |

OTHER PUBLICATIONS

Office Action mailed Sep. 9, 2014 issued in corresponding JP patent application No. 2013-546914 (and partial English translation).

International Search Report of the International Searching Authority mailed Jan. 17, 2012 for the corresponding international application No. PCT/JP2011/077732 (and English translation).

* cited by examiner

REFRIGERATION CYCLE DEVICE, EQUIPMENT, AND REFRIGERATION CYCLE METHOD

CROSS REFERENCE TO RELATED APPLICATIONS

This application is a U.S. national stage application of International Application No. PCT/JP2011/077732 filed on Nov. 30, 2011, the disclosure of which is incorporated herein by reference.

TECHNICAL FIELD

The present disclosure relates to a refrigeration cycle device, equipment, and a refrigeration cycle method.

BACKGROUND ART

The refrigeration cycle device generates cool air or the like by utilizing absorption and release of heat when a circulating refrigerant changes its phase from gas to liquid or from liquid to gas. Patent Literature 1 discloses an example of such refrigeration cycle device.

A refrigeration cycle device described in Patent Literature 1 below is provided with an accumulator (refrigerant-storing container, gas-liquid separator) which temporarily stores a refrigerant and which at the same time separates the gas refrigerant from the liquid refrigerant, and returns only the gas refrigerant to a compressor. The accumulator stores a fluid mixture of lubricating oil and the liquid refrigerant which has been discharged from the compressor and which has been refluxed back in a refrigerant circuit. If the fluid mixture is left to stand, the lubricating oil in the compressor may become insufficient. In order to solve the above-problem, Patent Literature 1 below discloses in Example 4 a refrigeration cycle device provided with an oil returning circuit which vaporizes the fluid mixture in the accumulator and returns it to a compressor.

CITATION LIST

Patent Literature

Patent Literature 1: Unexamined Japanese Patent Application Kokai Publication No. H8-5185

SUMMARY OF INVENTION

Technical Problem

In the refrigeration cycle device provided with an oil returning circuit described in the above Patent Literature 1, the higher the liquid level of a fluid mixture stored in the accumulator is, the higher the flow rate of the fluid mixture flowing in an oil returning circuit becomes; and the lower the liquid level is, the lower the flow rate of a refrigerant flowing in the oil returning circuit becomes. On the other hand, when the level of the fluid mixture becomes lower than an opening to the compressor, the fluid mixture does not flow in the oil returning circuit. As a result, the lubricating oil does not return to the compressor. In this case, the lubricating oil in the compressor is depleted, and the operation of the compressor becomes unstable, whereby the operation of the refrigeration cycle device may become unstable.

Due to the instability of the refrigeration cycle device, stable operation of equipment such as an air-conditioning device, a water heater, or a drinking water cooler which uses the refrigeration cycle device may also be impaired.

The present disclosure has been made under the above-mentioned circumstances, and an object of the disclosure is to provide a refrigeration cycle device which can conduct stable operation, equipment and a refrigeration cycle method using the refrigeration cycle device.

Another object of the disclosure is to provide a refrigeration cycle device, equipment, and a refrigeration cycle method in which lubricating oil in a stored fluid mixture can be stably returned to a compressor.

Solution to Problem

In order to attain the above objects, a refrigeration cycle device of the disclosure comprises:

a compressor that constitutes a refrigeration cycle and compresses a supplied refrigerant;

a refrigerant-retaining container that retains a refrigerant into which lubricating oil for the compressor has been mixed, and which separates the gas refrigerant from the liquid refrigerant, and sends out the gas refrigerant to the compressor;

a conveying device that conveys out a fluid mixture including the liquid refrigerant and the lubricating oil retained within the refrigerant-retaining container; and a vaporizer that changes the liquid refrigerant in the fluid mixture conveyed out from the refrigerant-retaining container by the conveying device to the gas refrigerant, and provides the compressor with the gas refrigerant together with the lubricating oil.

Advantageous Effects of Invention

Since the refrigeration cycle device, equipment, and refrigeration cycle method of the present disclosure include the conveying device which conveys out the fluid mixture containing the liquid refrigerant and the lubricating oil retained in the refrigerant-retaining container, or a conveying step in which the liquid refrigerant is conveyed out, stable operation is possible, as well as the lubricating oil in the stored fluid mixture can be stably returned to the compressor.

DESCRIPTION OF EMBODIMENTS

Embodiment 1

An air-conditioning device 10 provided with a refrigeration cycle device 100 of Embodiments of the disclosure will now be described with reference to FIGS. 1 to 4.

Figure 1:
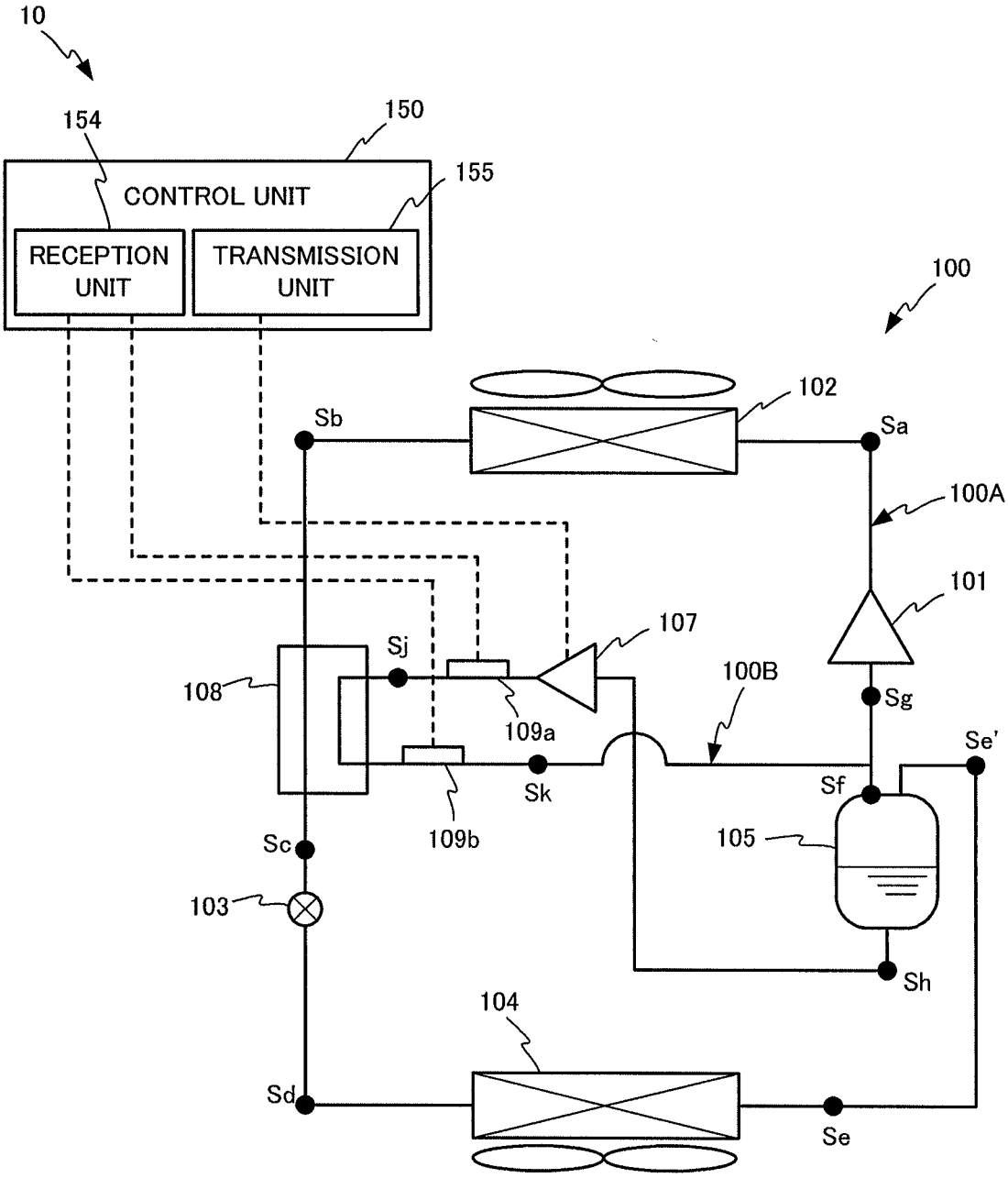
FIG. 1 is a schematic diagram illustrating an air-conditioning device of Embodiment 1 of the disclosure.

The air-conditioning device 10 of the Embodiment supplies cool air or warm air, and, as illustrated in FIG. 1, is provided with the refrigeration cycle device 100 including a main circuit 100A and a bypass circuit 100B, and a control unit 150 which controls the refrigeration cycle device 100.

The main circuit 100A of the refrigeration cycle device 100 refluxes refrigerant, as well as generates cool air and warm air by absorption and release of heat accompanied by phase change of the refrigerant, and is provided with a compressor 101, a condenser 102, an expansion valve 103, an evaporator 104, a refrigerant-storing container (accumulator) 105, and a pipe-shaped flow channel which connects all of the above portions.

The compressor 101 comprises, for example, a scroll compressor and a screw compressor, and it compresses the gas refrigerant to send out. This compression increases the temperature and the pressure of the gas refrigerant. The compressor 101 sends out the high-temperature and high-pressure gas refrigerant to a condenser 102 via a flow channel. It is noted that, in the compressor 101, lubricating oil is used for smooth operation of a moving member, and a part of the lubricating oil is mixed within the refrigerant.

The condenser 102 cools a high-temperature and high-pressure gas refrigerant which has flowed in by heat exchange with outside air and changes the refrigerant into the low-temperature liquid refrigerant, and then sends out the refrigerant to the expansion valve 103 via a flow channel. The condenser 102 is, for example, arranged outside a room whose air is to be conditioned by the air-conditioning device 10 and is constituted as a part of an outdoor unit of the air-conditioning device 10.

The expansion valve 103 expands the liquid refrigerant which has flowed in. At this point, the liquid refrigerant expands isenthalpically and changes into the low-pressure refrigerant having a low dryness. The generated low-pressure refrigerant is sent out to an evaporator 104 via a flow channel.

The evaporator 104 is arranged near the expansion valve 103, heats the low-pressure refrigerant which has flowed in by heat exchange with outside air, changes the refrigerant into the low-pressure refrigerant having a high dryness, and sends out the refrigerant to a refrigerant-storing container 105 via a flow channel. The evaporator 104 is arranged in a room whose air is to be conditioned by the air-conditioning device 10, and cool air after the heat exchange is conveyed to the room.

The refrigerant-storing container 105 stores the refrigerant which has flowed in from the evaporator 104. The refrigerant which has flowed into the refrigerant-storing container 105 is separated by gravity into the refrigerant (liquid refrigerant) in a liquid phase and the lubricating oil which is mixed therein and the refrigerant (gas refrigerant) in a gas phase having a lower specific gravity than that of the liquid refrigerant. Among these, the gas refrigerant is supplied to the compressor 101 via a flow channel. On the other hand, the liquid refrigerant together with the lubricating oil is stored at the bottom of the refrigerant-storing container 105. The neighborhood of the bottom of the refrigerant-storing container 105 is configured, for example, as a curved surface.

On the other hand, the bypass circuit 100B of the refrigeration cycle device 100 is a circuit which returns lubricating oil in the fluid mixture stored at the bottom of the refrigerant-storing container 105 to the compressor 101, and at the same time vaporizes the liquid refrigerant to be supplied to the compressor 101. The bypass circuit 100B is connected to the bottom of the refrigerant-storing container 105 and at the same time connected to the upstream of the compressor 101. The bypass circuit 100B comprises a refrigerant conveying pump 107, an internal heat exchanger 108, and a pair of temperature sensors 109*a*, 109*b*.

The refrigerant conveying pump 107 is an active device which sucks in a fluid mixture comprising the liquid refrigerant and the lubricating oil retained in the refrigerant-storing container 105, and sends out the fluid mixture to an internal heat exchanger 108, thereby stably conveying the fluid mixture from the bypass circuit 100B at a constant flow rate. The refrigerant conveying pump 107 comprises, for example, an axial pump, a positive displacement pump, and the like. The refrigerant conveying pump 107 is connected to a commercial power source via a power cable or the like, and an electric power is supplied to the refrigerant conveying pump 107 from a commercial power source. The refrigerant conveying pump 107 sucks in the fluid mixture retained in the refrigerant-storing container 105 at the constant pressure and pushes out the mixture, whereby the refrigerant conveying pump 107 can stably convey the refrigerant regardless of the liquid level or the amount of the fluid mixture in the refrigerant-storing container 105, the position where the compressor 101 is arranged, or the like. The lubricating oil retained in the refrigerant-storing container 105 can also be returned to the compressor 101 by way of the bypass circuit 100B.

The internal heat exchanger 108 performs heat exchange between the high-temperature liquid refrigerant sent out from the condenser 102 and the fluid mixture flowing within the bypass circuit 100B, thereby increasing the temperature of the fluid mixture. By this, the liquid refrigerant evaporates and changes into the gas refrigerant. The gas refrigerant passes a flow channel from the internal heat exchanger 108 and is returned to the compressor 101.

The temperature sensors 109*a*, 109*b* are arranged near an inlet and outlet of the internal heat exchanger 108, respectively. The temperature sensor 109*a* measures the temperature Tj of the fluid mixture before the fluid mixture passes through the internal heat exchanger 108. The temperature sensor 109*b* measures the temperature Tk of the fluid mixture after the fluid mixture passes through the internal heat exchanger 108.

Figure 2:
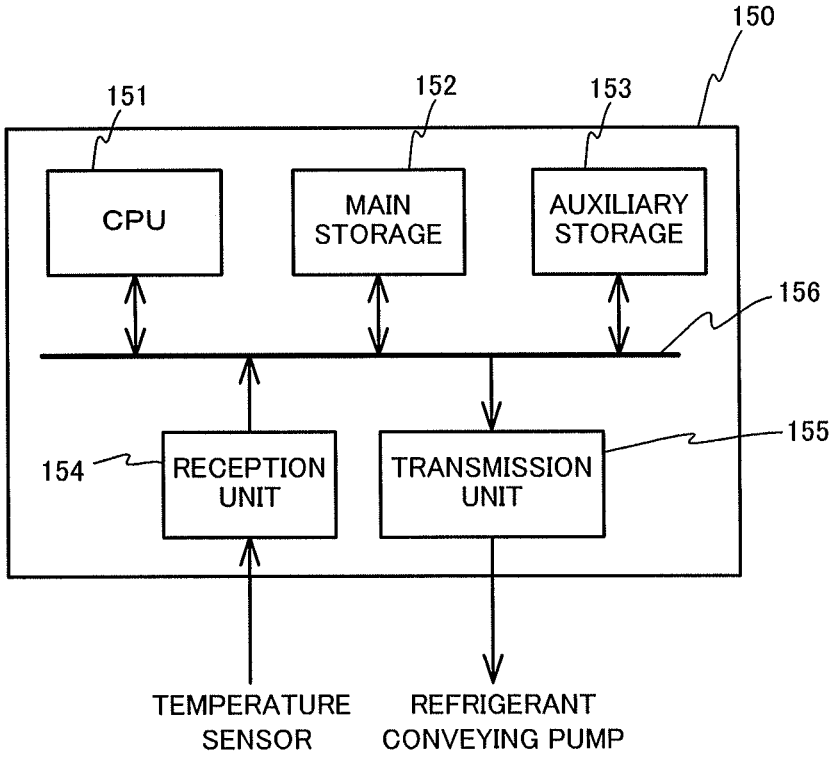
FIG. 2 is a block diagram of a control unit of the air-conditioning device of Embodiment 1.

The control unit 150 controls the refrigeration cycle device 100, and, as illustrated in FIG. 2, comprises a CPU (Central Processing Unit) 151, a main storage 152, an auxiliary storage 153, a reception unit 154, a transmission unit 155, and a bus 156 which connects the above-mentioned units each other. The control unit 150 integrally comprises, for example, a remote control of the air-conditioning device 10.

The main storage 152 comprises a RAM (Random Access Memory) or the like, and is used as a working storage for the CPU 151.

The auxiliary storage 153 includes a nonvolatile memory such as a ROM (Read Only Memory), a magnetic disk, or a semiconductor memory. The auxiliary storage 153 stores a program to be executed by the CPU 151 and a variety of parameters or the like.

The reception unit 154 is connected to the temperature sensors 109*a*, 109*b* through a cable or the like. The reception unit 154 receives signals representing measured the temperatures Tj, Tk from the temperature sensors 109*a*, 109*b*, and notifies the CPU 151 of the measured the temperatures Tj, Tk via the bus 156.

The transmission unit 155 is connected to the refrigerant conveying pump 107 through a cable or the like. The transmission unit 155 transmits a signal for adjusting the flow rate of the refrigerant which is conveyed by the refrigerant conveying pump 107 to the refrigerant conveying pump 107 according to an instruction from the CPU 151.

The CPU 151 executes the program stored in the auxiliary storage 153, and controls the above-mentioned units as a whole.

Figure 3:
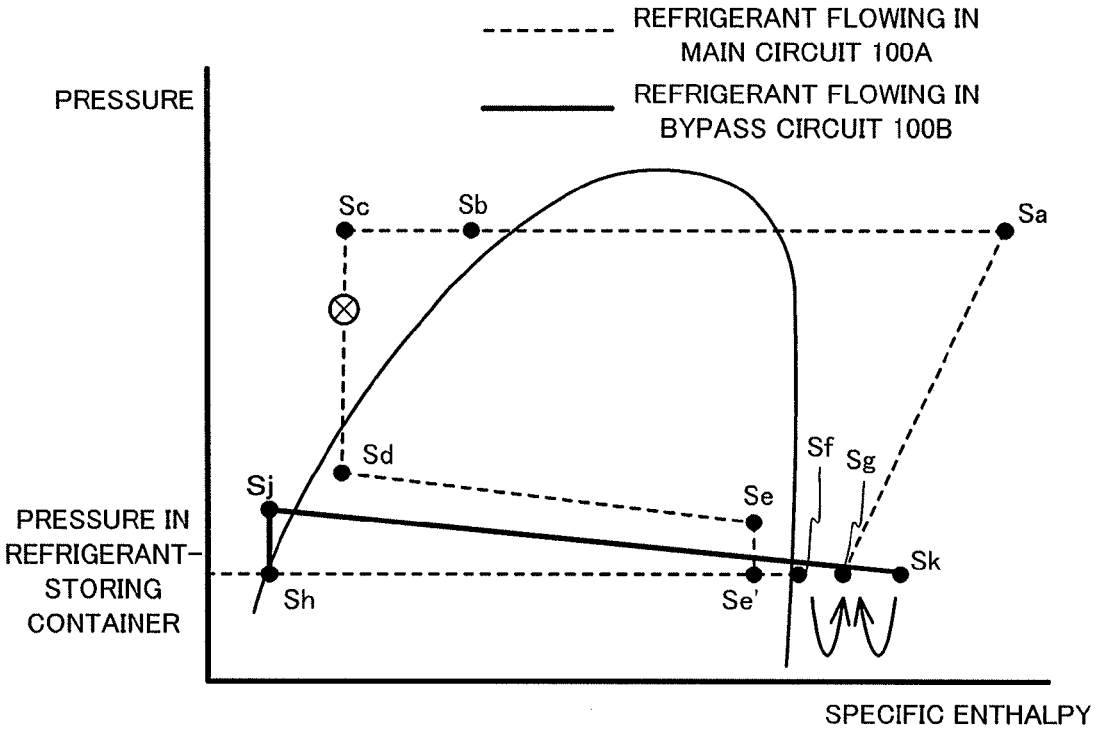
FIG. 3 is a Mollier diagram for explanation of the operation of the air-conditioning device of Embodiment 1.

Next, changes of a state of the refrigerant during operation will now be described using FIG. 3 by taking heating operation of the air-conditioning device 10 as an example. The axis of abscissas of a Mollier diagram in FIG. 3 indicates the enthalpy (specific enthalpy) per unit mass of the refrigerant. The axis of coordinate indicates the pressure of the refrigerant. Points, Sa, Sb, Sc, Sd, Se, Se', Sf, Sg, Sh, Si, Sj, and Sk, in FIG. 3 represent states of the refrigerant at points, Sa, Sb, Sc, Sd, Se, Se', Sf, Sg, Sh, Si, Sj, and Sk, in FIG. 1, respectively.

First, changes of the state of the refrigerant which flows within the main circuit 100A will be described.

When a high-temperature and low-pressure gas refrigerant (state Sg) flows into the compressor 101, the gas refrigerant (state Sg) is compressed by the compressor 101. As a result, the pressure and specific enthalpy of the refrigerant increase, and the refrigerant changes from the state Sg to the high-temperature and high-pressure state (state Sa) as shown in FIG. 3. Then, the refrigerant is sent out from the compressor 101 as the high-temperature and high-pressure gas refrigerant (state Sa). At this time, a small amount of the lubricating oil mixed within the refrigerant is in the liquid state. In this case, the refrigerant is sent out as the fluid mixture containing the lubricating oil in mist.

When the fluid mixture in the high-temperature and high-pressure gas state (state Sa) flows into the condenser 102, the fluid mixture in the state Sa is condensed by heat exchange with outside air. As a result, the specific enthalpy of the fluid mixture decreases while the fluid mixture is maintained at the constant pressure. By this, the fluid mixture changes from the high-temperature gas state (state Sa) to the low-temperature liquid state (state Sb). Then, the fluid mixture is sent out as the liquid fluid mixture in the low-temperature and high-pressure state (state Sb) from the condenser 102.

When the liquid fluid mixture in the low-temperature and high-pressure state (state Sb) flows into the internal heat exchanger 108, the fluid mixture in the state Sb is further cooled by heat exchange with the refrigerant which flows within the bypass circuit 100B. As a result, only the specific enthalpy of the fluid mixture further decreases while the pressure of the fluid mixture is maintained at the constant pressure. By this, the fluid mixture further changes from the state Sb to the low-temperature state (state Sc). Then, the fluid mixture is sent out from the internal heat exchanger 108 as the liquid fluid mixture in the low-temperature and high-pressure state (state Sc).

When the liquid fluid mixture in the low-temperature and high-pressure state (state Sc) flows into the expansion valve 103, the fluid mixture expands through the expansion valve 103. As a result, the pressure of the fluid mixture decreases while the specific enthalpy of the fluid mixture is maintained constant. By this, the fluid mixture changes from the high-pressure state (state Sc) to the low-pressure state (state Sd). The refrigerant contained in the fluid mixture at this time is the two-phase refrigerant including the gas refrigerant and the liquid refrigerant. Then, the fluid mixture is sent out from the expansion valve 103 as the fluid mixture in the low-temperature and low-pressure state (state Sd).

When the fluid mixture in the low-temperature and low-pressure state (state Sd) flows into the evaporator 104, the fluid mixture evaporates by heat exchange with outside air. As a result, the specific enthalpy of the fluid mixture increases. By this, the refrigerant contained in the fluid mixture changes from the state in which the dryness of the refrigerant is low (state Sd) to the state in which the dryness of the refrigerant is high (state Se). It is noted that, at this time, the pressure of the fluid mixture decreases to some extent. Then, the fluid mixture is sent out from the evaporator 104 as the fluid mixture containing the refrigerant having the high dryness (the refrigerant in the state Se). At this time, the fluid mixture also including the liquid refrigerant which has not sufficiently changed to the gas fluid mixture is sent out. In other words, the fluid mixture containing the two-phase refrigerant of the gas refrigerant and the liquid refrigerant is sent out.

The pressure of the fluid mixture in the state Se which has been sent out from the evaporator 104 decreases to some extent due to the friction with the inner circumferential surface of a refrigerant flow channel connecting the evaporator 104 and the refrigerant-storing container 105. By this, the fluid mixture changes from the state Se to the state Se'.

When the fluid mixture in the state Se' flows into the refrigerant-storing container 105, the fluid mixture is separated by the refrigerant-storing container 105 into the fluid mixture in the state Sh comprising the lubricating oil and the liquid refrigerant having a high density, and the gas refrigerant having a low density (state Sf). The fluid mixture in the state Sh is retained near the bottom part of the refrigerant-storing container 105. On the other hand, the gas refrigerant in the state Sf moves to an upper part of the refrigerant-storing container 105. Then, the gas refrigerant in the state Sf is returned to the compressor 101 again.

Next, changes of the state of the refrigerant which flows within the bypass circuit 100B will now be described.

The refrigerant conveying pump 107 of the bypass circuit 100B sucks in the liquid fluid mixture in the state Sh which is retained at the bottom part of the refrigerant-storing container 105, and compulsively conveys the liquid fluid mixture. At this time, the pressure of the fluid mixture increases while the specific enthalpy of the fluid mixture is maintained constant by the refrigerant conveying pump 107. By this, the fluid mixture changes from the state Sh to the state Sj. Then, the fluid mixture is sent out as the fluid mixture in the state Sj from the refrigerant conveying pump 107 to the internal heat exchanger 108.

When the refrigerant conveying pump 107 provides the internal heat exchanger 108 with the liquid fluid mixture in the state Sj, the fluid mixture is heated by heat exchange with the refrigerant which flows within the main circuit 100A. As a result, the specific enthalpy of the fluid mixture increases. By this, the fluid mixture changes from the state Sj to the high-temperature gas state (state Sk). The gas fluid mixture in the state Sk contains the lubricating oil in mist. It is noted that, at this time, the pressure of the fluid mixture decreases to some extent. The fluid mixture is sent out as the fluid mixture in the high-temperature and low-pressure gas state (state Sk) from the internal heat exchanger 108.

The fluid mixture in the gas state Sk merges with the fluid mixture in the gas state Sf at the upstream of the compressor 101. The fluid mixture in the state Sk and the fluid mixture in the state Sf are mixed together, and as a result, the refrigerant becomes the fluid mixture in the state Sg to be sent out to the compressor 101. Since the fluid mixture in the state Sg contains the lubricating oil, the lubricating oil circulates within the main circuit 100A and the bypass circuit 100B, and flows into the compressor 101 again. A predetermined amount of the lubricating oil is thus secured inside the compressor 101.

Figure 4:
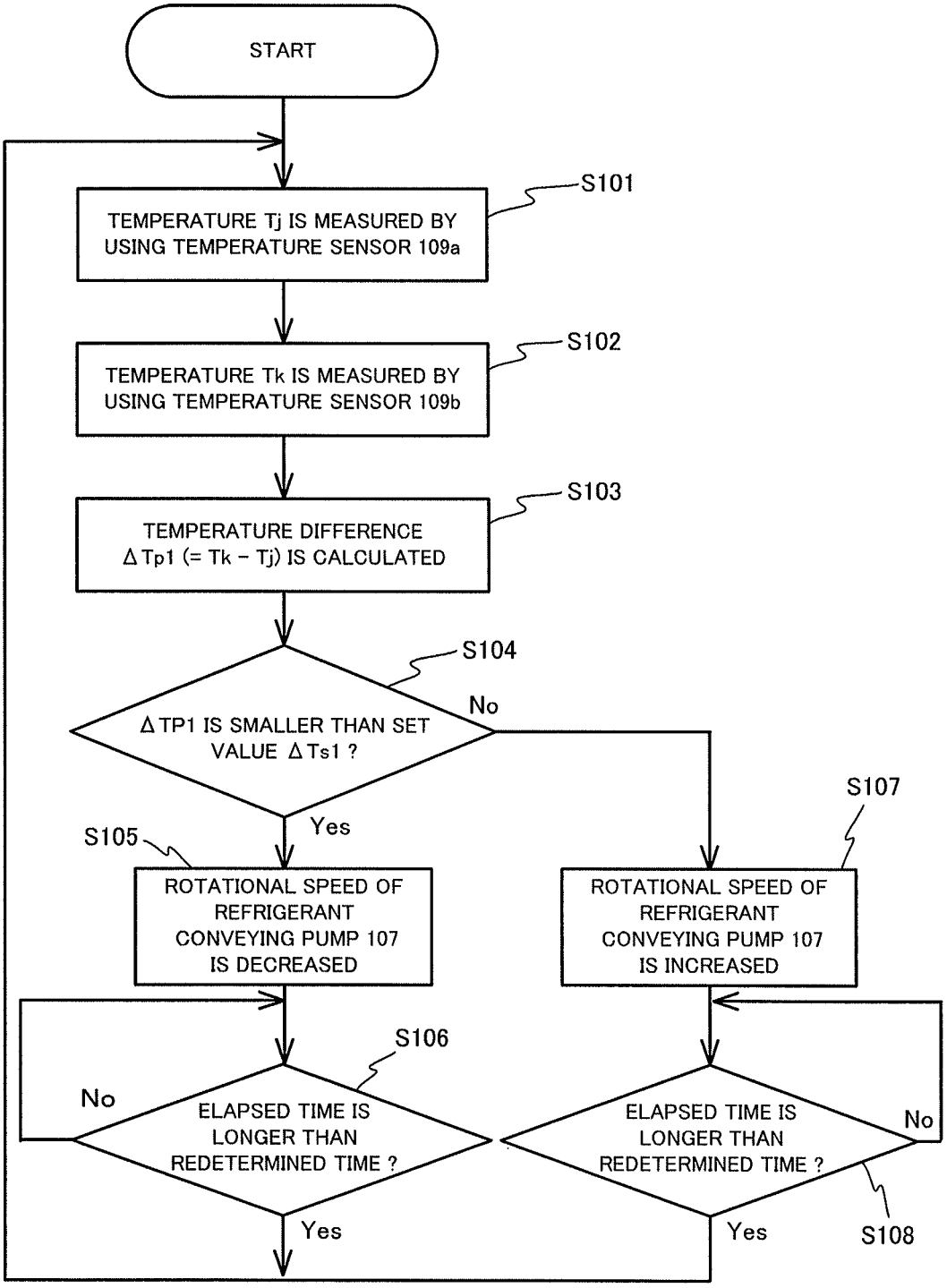
FIG. 4 is a flow chart for explanation of the operation of the air-conditioning device of Embodiment 1.

Next, the operation of the refrigerant conveying pump 107 and control unit 150 in the refrigeration cycle device 100 will be described using FIG. 4. A flow chart depicted in FIG. 4 shows a series of processes to be executed by the CPU 151 of the control unit 150.

First, the CPU 151 executes measurement by using the temperature sensor 109*a* (step S101). Specifically, the CPU 151 measures the temperature Tj of the fluid mixture in the state Sj near the inlet of the internal heat exchanger 108 by using the temperature sensor 109*a*. After the measurement of the temperature Tj by using the temperature sensor 109*a*, the CPU 151 progresses the process to next step S102.

Next, the CPU 151 executes measurement by using the temperature sensor 109*b* (step S102). Specifically, the CPU 151 measures the temperature Tk of the fluid mixture in the state Sk near the exit of the internal heat exchanger 108 by using the temperature sensor 109*b*. After the measurement of the temperature Tk by using the temperature sensor 109*b*, the CPU 151 progresses the process to next step S103.

Next, the CPU 151 subtracts Tj from Tk, and calculates the temperature difference ΔTp1 (=Tk−Tj) (step S103). After the calculation of the temperature difference ΔTp1, the CPU 151 progresses the process to next step S104.

Next, the CPU 151 compares the calculated temperature difference ΔTp1 and a set value ΔTs1 stored in the auxiliary storage 153 in advance, and judges whether the temperature difference ΔTp1 is smaller than the ΔTs1 or not (step S104). In cases in which the temperature difference ΔTp1 is judged to be smaller than the set value ΔTs1 (step S104: Yes), the CPU 151 progresses the process to next step S105.

Next, the CPU 151 reduces the rotational speed of the refrigerant conveying pump 107 (step S105). For example, the CPU 151 reduces the rotational speed by 10%. By this, the output of the refrigerant conveying pump 107 decreases, and the flow rate of the fluid mixture which flows within the bypass circuit 100B decreases. As a result, the amount of heat exchanged in the internal heat exchanger 108 increases and the temperature of the fluid mixture increases. As a result, the temperature difference ΔTp1 increases. Then, the CPU 151 progresses the process to next step S106.

Next, the CPU 151 judges whether an elapsed time from when the rotational speed of the refrigerant conveying pump 107 is reduced is a predetermined time or more or not (step S106). In cases in which the elapsed time from when the rotational speed of the refrigerant conveying pump 107 is reduced is judged to be a predetermined time or more (step S106: Yes), the CPU 151 progresses the process to next step S101. Then, measurement is executed again by using the temperature sensor 109*a*. In cases in which the elapsed time from when the rotational speed of the refrigerant conveying pump 107 is reduced is judged to be less than the predetermined time (step S106: No), the CPU 151 progresses the process to next step S106, and again, the CPU 151 judges whether the elapsed time from when the rotational speed of the refrigerant conveying pump 107 is reduced is the predetermined time or more or not.

On the other hand, in cases in which, in step S104, the temperature difference ΔTp1 is judged to be the set value ΔTs1 or larger (step S104: No), the CPU 151 progresses the process to next step S107.

Next, the CPU 151 increases the rotational speed of the refrigerant conveying pump 107 (step S107). For example, the rotational speed increases by 10%. By this, the output of the refrigerant conveying pump 107 increases, whereby the flow rate of the fluid mixture which flows within the bypass circuit 100B increases. As a result, the amount of heat exchanged in the internal heat exchanger 108 decreases, and the temperature of the fluid mixture is reduced. As a result, the temperature difference ΔTp1 decreases. Then, the CPU 151 progresses the process to next step S108.

Next, the CPU 151 judges whether an elapsed time from when the rotational speed of the refrigerant conveying pump 107 increases is a predetermined time or more or not (step S108). In cases in which the elapsed time from when the rotational speed of the refrigerant conveying pump 107 increases is judged to be a predetermined time or more (step S108: Yes), the CPU 151 progresses the process to next step S101, and again, executes measurement by using the temperature sensor 109*a*. In cases in which the elapsed time from when the rotational speed of the refrigerant conveying pump 107 is reduced is judged to be less than the predetermined time (step S108: No), the CPU 151 progresses the process to next step S108, and again, the CPU 151 judges whether the elapsed time from when the rotational speed of the refrigerant conveying pump 107 is reduced is the predetermined time or more or not.

As described above, the bypass circuit 100B of the refrigeration cycle device 100 according to the Embodiment 1 is provided with the refrigerant conveying pump 107 which sucks in and sends out the liquid refrigerant retained in the refrigerant-storing container 105 and the lubricating oil. By this, stable operation becomes possible regardless of the positional relationship between the compressor 101 and the refrigerant-storing container 105, and at the same time, the lubricating oil stored in the fluid mixture can be stably returned to the compressor 101.

For example, in the case of ache refrigeration cycle device which does not comprise the refrigerant conveying pump, when the oil level of the liquid fluid mixture retained in the refrigerant-storing container 105 is lower than the compressor 101, the lubricating oil can not be returned to the compressor 101, and therefore, it is difficult to secure a predetermined amount of the lubricating oil in the compressor 101. For this reason, scorch of a moving member of the compressor 101 occurs, and the reliability of the refrigeration cycle device may be deteriorated.

In contrast, in the refrigeration cycle device 100 according to the Embodiment 1, even in cases in which the oil level of the liquid fluid mixture retained in the refrigerant-storing container 105 is lower than an opening to the compressor, the lubricating oil can be returned to the compressor 101, thereby securing a predetermined amount of the lubricating oil in the compressor 101. Scorch of the moving member of the compressor 101 caused by depletion of the lubricating oil can be thus avoided, thereby improving the reliability of the refrigeration cycle. The refrigerant-storing container 105 can be arranged at the same height as or at a height lower than the compressor 101, thereby improving the degree of freedom of the structural design.

The bypass circuit 100B of the refrigeration cycle device 100 according to the Embodiment 1 comprises the temperature sensors 109*a*, 109*b*. By this, the flow rate of the fluid mixture of the refrigerant conveying pump 107 can be adjusted appropriately according to the temperature of the refrigerant at the inlet and the temperature of the refrigerant at the outlet of the internal heat exchanger 108.

Embodiment 2

Although, in the Embodiment 1, the pump is illustrated as a constitution in which the fluid mixture of the liquid refrigerant and the lubricating oil is conveyed out from the refrigerant-storing container, any constitution is optional as long as the constitution is a conveying device which can stably convey out the fluid mixture. Embodiment 2 in which an ejector is used as the conveying device will now be described by using FIGS. 5 to 8. The same reference signs are used for the same or similar constitution in Embodiment 1. An air-conditioning device 20 according to the present Embodiment is different from the air-conditioning device 10 according to Embodiment 1 in that the air-conditioning device 20 comprises an ejector 250 in place of the refrigerant conveying pump 107.

Figure 5:
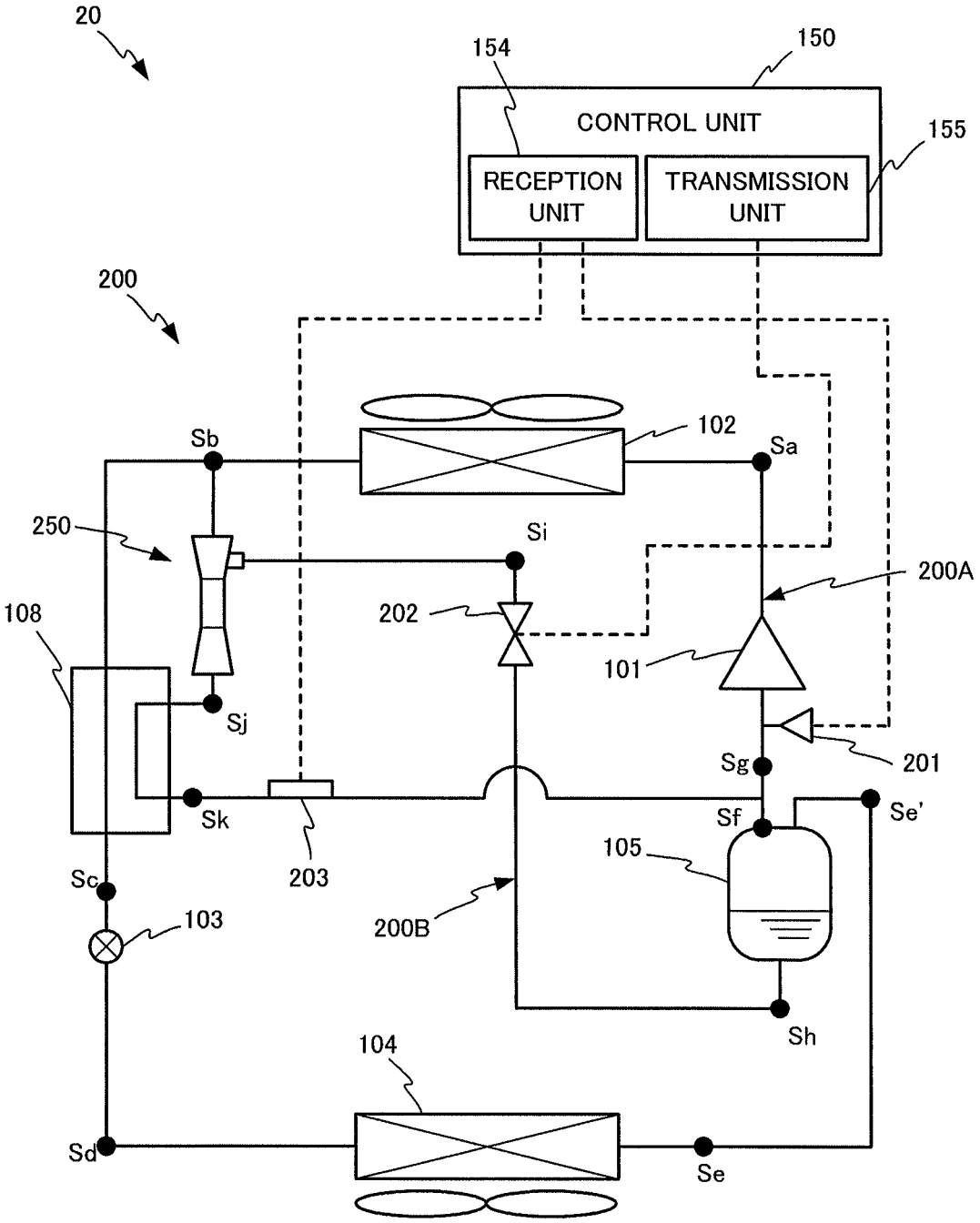
FIG. 5 is a schematic diagram illustrating an air-conditioning device of Embodiment 2.

As illustrated in FIG. 5, the air-conditioning device 20 comprises a refrigeration cycle device 200 including a main circuit 200A and a bypass circuit 200B, and a control unit 150 which controls the refrigeration cycle device 200.

The main circuit 200A comprises the compressor 101, the condenser 102, the expansion valve 103, the evaporator 104, the refrigerant-storing container 105 (accumulator) and the like which are described in Embodiment 1, and further comprises a pressure sensor 201 detecting the pressure of the refrigerant which flows into the compressor 101. The output of the pressure sensor 201 is provided to the reception unit 154 of the control unit 150.

The bypass circuit 200B includes a flow rate control valve 202, a temperature sensor 203, and the ejector 250.

The flow rate control valve 202 controls the flow rate of the fluid mixture in the liquid state which has been conveyed from the refrigerant-storing container 105, thereby adjusting the flow rate of the fluid mixture flowing into the ejector 250. The output of the transmission unit 155 of the control unit 150 is provided to the flow rate control valve 202.

The temperature sensor 203 is arranged near the outlet of the internal heat exchanger 108. The temperature sensor 203 measures the temperature of the fluid mixture after the fluid mixture passes through the internal heat exchanger 108 in a similar manner to the temperature sensor 109*b* of Embodiment 1.

Figure 6:
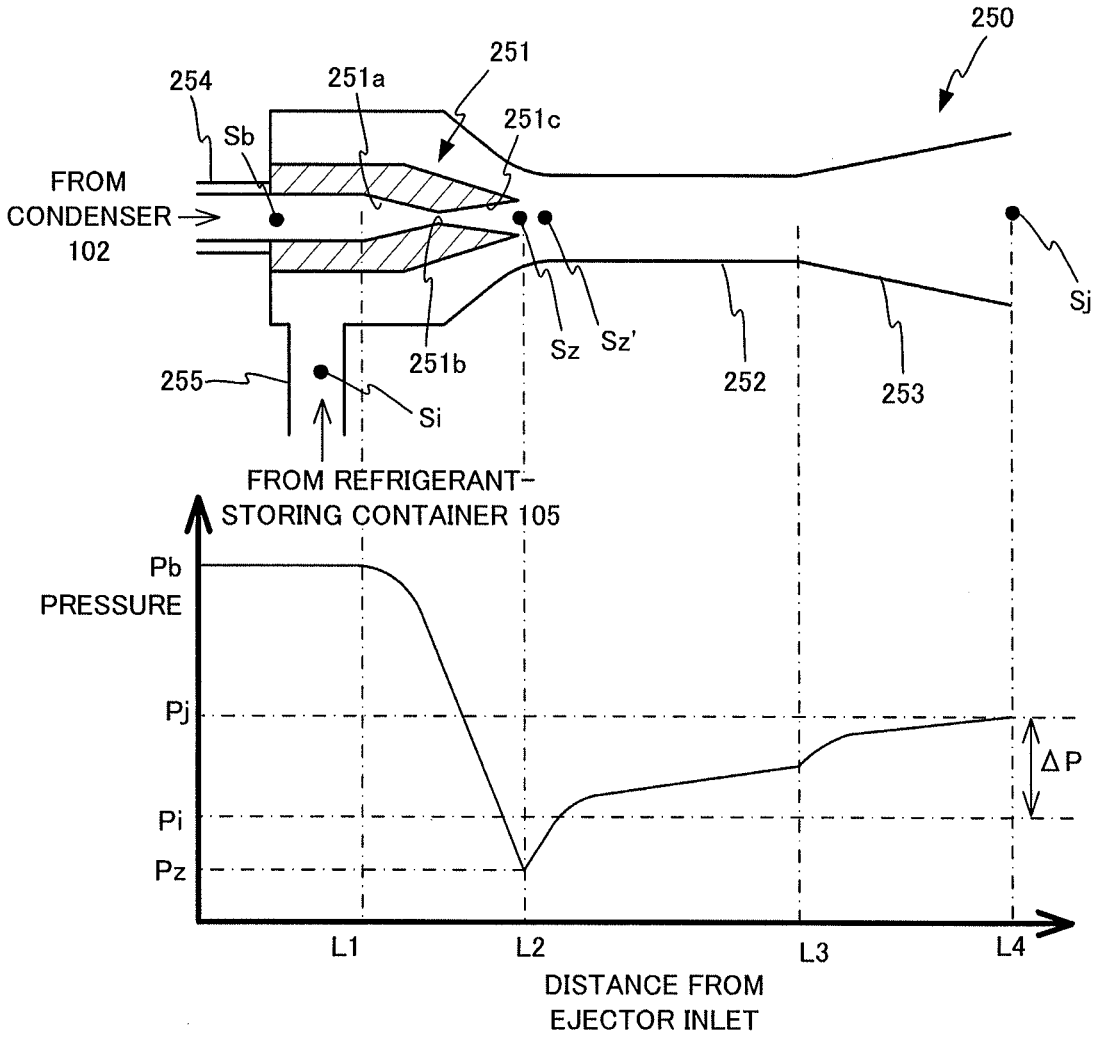
FIG. 6 is a diagram illustrating a cross section of an ejector and the relationship between a distance from an entrance of the ejector and the pressure.

As illustrated in FIG. 6, the ejector 250 includes a nozzle portion 251, a mixing portion 252, a diffuser portion 253, an inlet portion 254, and a suction portion 255. The fluid mixture which has been conveyed from the condenser 102 of the main circuit 200A flows into the inlet portion 254. Due to the negative pressure which is generated when the fluid mixture flows into from the inlet portion 254, the fluid mixture retained in the refrigerant-storing container 105 flows into the suction portion 255 via the bypass circuit 200B.

The nozzle portion 251 is a substantially pipe-shaped member, which comprises a pressure-reducing portion 251*a* whose pipe diameter is gradually reduced, a throat portion 251*b* whose pipe diameter is the smallest, and a widening portion 251*c* whose pipe diameter is gradually increased. The fluid mixture conveyed from the condenser 102 flows into the nozzle portion 251.

Next, changes in the pressure and rate of the fluid mixture conveyed to the ejector 250 will be described by using FIG. 6.

First, the high pressure fluid mixture (the fluid mixture in the state Sb) which has flowed out from the condenser 102 flows into the inlet portion 254 of the ejector 250. Since the inlet portion 254 has a constant pipe diameter as illustrated in the upper figure in FIG. 6, the pressure Pb of the fluid mixture is constant as illustrated in the lower figure in FIG. 6. Next, at the pressure-reducing portion 251*a* of the nozzle portion 251, the pressure of the fluid mixture which has passed through the inlet portion 254 gradually decreases as the pipe diameter of the pressure-reducing portion 251*a* decreases. After that, when the fluid mixture passes through the throat portion 251*b* whose pipe diameter is the smallest, the moving speed of the fluid mixture increases to a sonic speed. Further, when the fluid mixture passes the widening portion 251*c*, the moving speed of the fluid mixture increases to an ultra-sonic speed. At this time, the pressure of the refrigerant decreases to the pressure Pz which is lower than the pressure Pi of the refrigerant of the suction portion 255. As a result, the refrigerant flows out from the tip of the nozzle portion 251 at an ultra-high speed.

When the pressure of the refrigerant decreases to the pressure Pz at the nozzle portion 251, the fluid mixture retained in the refrigerant-storing container 105 is sucked in via the suction portion 255 due to the differential pressure since the pressure Pz is lower than the pressure Pi of the suction portion (Pz<Pi).

The refrigerant which has flowed out from the tip of the nozzle portion 251 and the refrigerant which has been sucked in by the suction portion 255 are mixed together at the mixing portion 252. At this time, the pressure of the refrigerant is gradually recovered by momentum exchange of the refrigerants. In addition, the speed of the refrigerant further decreases as the pipe diameter of the ejector 250 further increases at the diffuser portion 253. As the speed decreases, the pressure of the refrigerant increases up to the pressure Pj, and the refrigerant flows out from the ejector 250.

Figure 7:
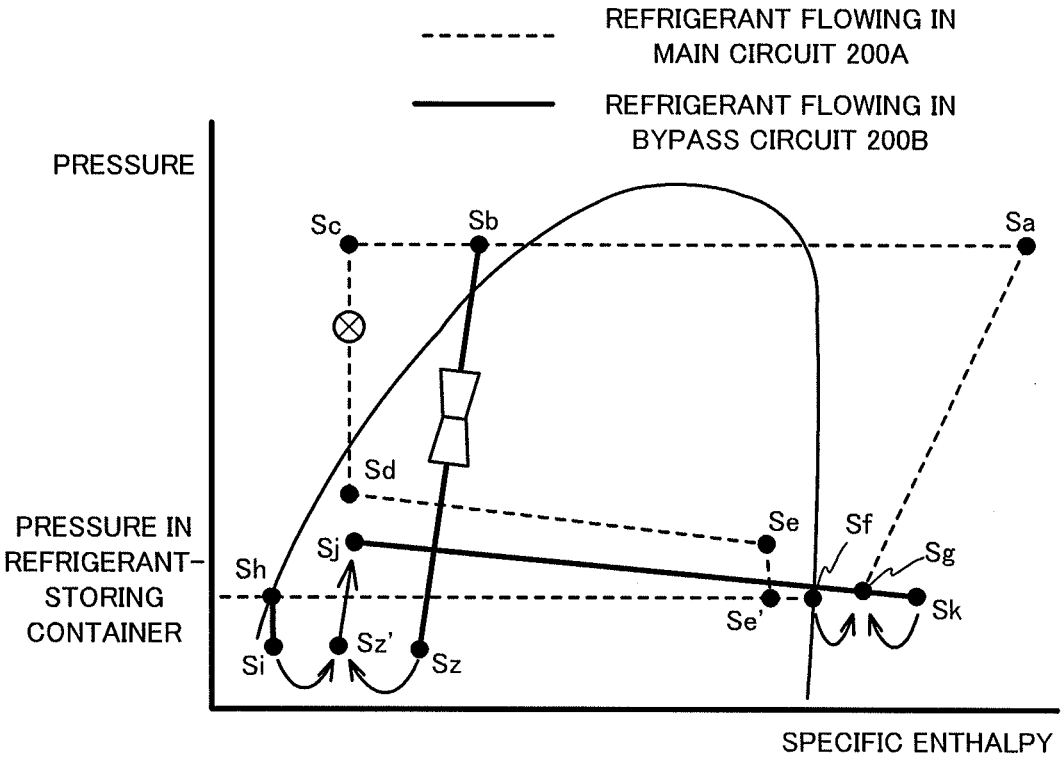
FIG. 7 is a Mollier diagram for explanation of the operation of the air-conditioning device of Embodiment 2.

Next, change in the state of the refrigerant in the refrigeration cycle device 200 will be described by using FIG. 7. The axis of abscissas in the Mollier diagram in FIG. 7 indicates the enthalpy per unit mass of the refrigerant (specific enthalpy). Points, Sa, Sb, Se, Sd, Se, Se', Sf, Sg, Sh, Si, Sj, and Sk, in FIG. 5, and points, Sz, Sz', in FIG. 6 represent states of the refrigerant at points, Sa, Sb, Sc, Sd, Se, Se', Sf, Sg, Sh, Si, Sj, Sk, Sz, and Sz', in FIG. 7 respectively.

A part of the fluid mixture which has reached the high-pressure state (state Sb) after passing through the condenser 102 flows from the main circuit 200A into the bypass circuit 200B. The pressure of the fluid mixture which has flowed into the bypass circuit 200B is reduced when the fluid mixture passes through the ejector 250, and the fluid mixture changes from the state Sb to the state Sz. Then, the fluid mixture in the state Sz flows out from the tip of the nozzle portion 251 at an ultra-high speed as the driving refrigerant.

When the driving refrigerant flows out from the nozzle portion 251 at an ultra-high speed, the fluid mixture in the state Sh retained in the refrigerant-storing container 105 is sucked into the ejector 250. By controlling the flow rate by the flow rate control valve 202, the pressure of the fluid mixture decreases, and the fluid mixture in the state Sh changes from the state Sh to the state Si.

The fluid mixture in the state Sz and the fluid mixture in the state Si are merged with at the mixing portion 252 of the ejector 250. The fluid mixture in the state Sz and the fluid mixture in the state Si are mixed together, thereby obtaining the fluid mixture in the state Sz'. Then, when the pressure of the fluid mixture increases at the mixing portion 252 and the diffuser portion 253 of the ejector 250, the fluid mixture in the state Sz' changes from the state Sz' to the state Sj. The fluid mixture in the state Sj is thus sent out from the ejector 250.

The fluid mixture in the state Sj which has flowed into the internal heat exchanger 108 is heated by heat exchange with the refrigerant flowing in the main circuit 200A. As a result, the specific enthalpy of the fluid mixture increases, and the fluid mixture changes from the state Sj to the high-temperature gas state (state Sk). The lubricating oil in mist is contained in the fluid mixture in the state Sk. It is noted that, at this time, the pressure of the fluid mixture decreases to some extent. The fluid mixture in the high-temperature gas state (state Sk) is sent out from the internal heat exchanger 108.

The fluid mixture in the gas state Sk merges with the fluid mixture in the gas state Sf at the upstream of the compressor 101. The fluid mixture in the state Sk and the fluid mixture in the state Sf are mixed together, thereby obtaining the fluid mixture in the state Sg. The fluid mixture is sent out to the compressor 101. Since the fluid mixture in the state Sg contains the lubricating oil, the lubricating oil flows into the compressor 101. A predetermined amount of the lubricating oil is thus secured inside the compressor 101.

Figure 8:
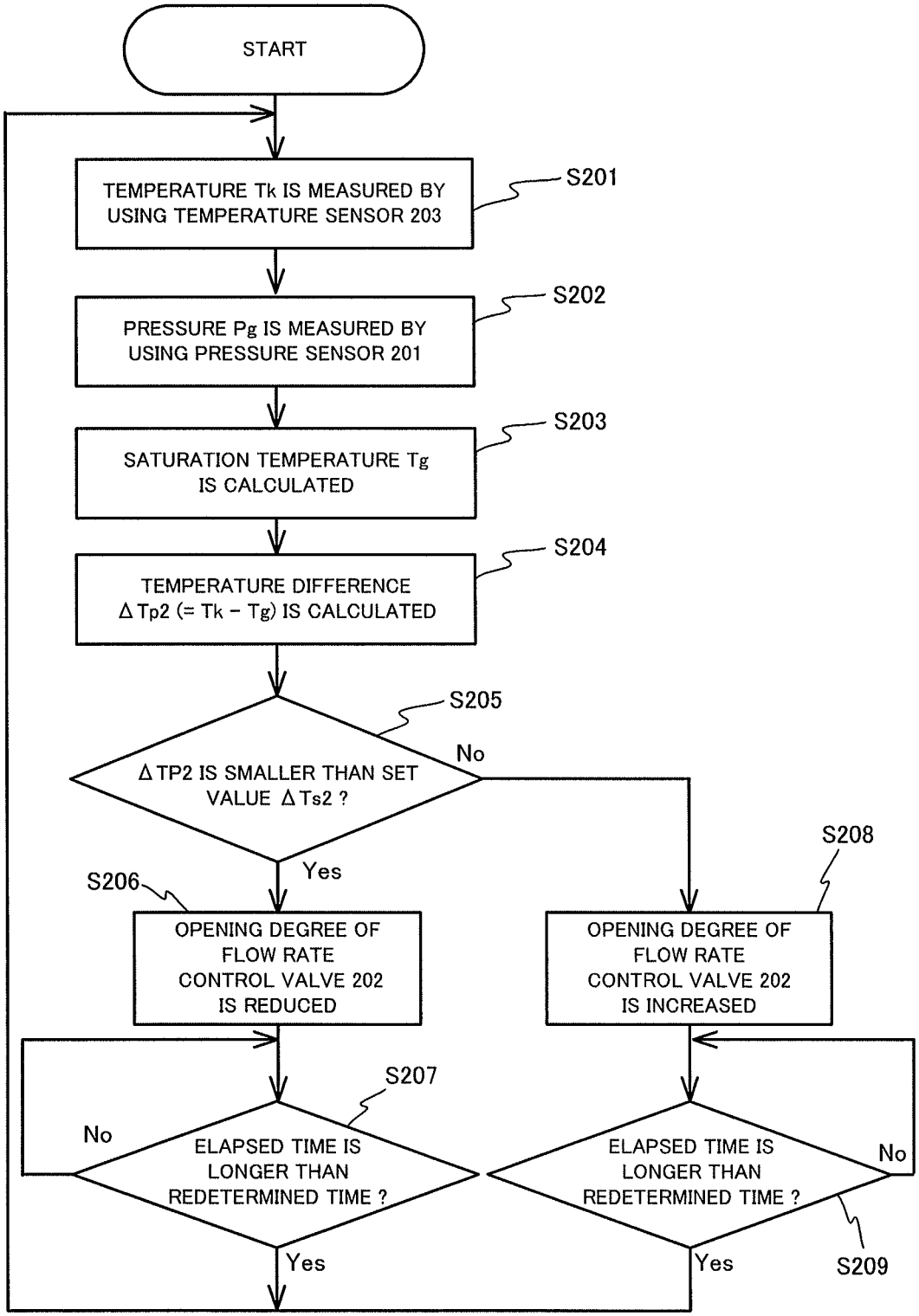
FIG. 8 is a flow chart for explanation of the operation of the air-conditioning device of Embodiment 2.

Next, the operation of the control unit 150 in the refrigeration cycle device 200 will be described using FIG. 8. A flow chart depicted in FIG. 8 shows a series of processes to be executed by the CPU 151 of the control unit 150.

First, the CPU 151 executes measurement by using the temperature sensor 203 (step S201). Specifically, the CPU 151 measures the temperature Tk of the fluid mixture in the state Sk near the outlet of the internal heat exchanger 108 by using the temperature sensor 203. After the measurement of the temperature Tk by using the temperature sensor 203, the CPU 151 progresses the process to next step S202.

Next, the CPU 151 executes measurement by using the pressure sensor 201 (step S202). Specifically, the CPU 151 measures the pressure Pg of the fluid mixture in the state Sg at the upstream of the compressor 101 by using the pressure sensor 201. After the measurement of the pressure Pg by using the pressure sensor 201, the CPU 151 progresses the process to next step S203.

Next, the CPU 151 calculates the saturation temperature Tg by the pressure Pg of the fluid mixture in the state Sg detected by the pressure sensor 201 (step S203). After the calculation of the saturation temperature Tg, the CPU 151 progresses the process to next step S204.

Next, the CPU 151 calculates the temperature difference ΔTp2 (=Tk−Tg) based on the saturation temperature Tg calculated in step S203 and the temperature Tk detected by the temperature sensor 203 (step S204). After the calculation of the temperature difference ΔTp2, the CPU 151 progresses the process to next step S205.

The CPU 151 compares the calculated temperature difference ΔTp2 and a set value ΔTs2 which is stored in the auxiliary storage 153 in advance, and judges whether the temperature difference ΔTp2 is less than the ΔTs2 or not (step S205). In cases in which the temperature difference ΔTp2 is judged to be less than the set value ΔTs2 (step S205: Yes), the CPU 151 progresses the process to next step S206.

Next, the CPU 151 reduces the opening degree of the flow rate control valve 202 (step S206). By this, the flow rate in the bypass circuit 200B decreases, and the temperature difference ΔTp2 increases. Then the CPU 151 progresses the process to next step S207.

Next, the CPU 151 judges whether an elapsed time from when the opening degree of the flow rate control valve 202 is reduced is a predetermined time or more or not (step S207). In cases in which the elapsed time from when the opening degree of the flow rate control valve 202 is reduced is judged to be a predetermined time or more (step S207: Yes), the CPU 151 progresses the process to next step S201 and a measurement is executed again by using the temperature sensor 203. On the other hand, in cases in which the elapsed time from when the opening degree of the flow rate control valve 202 increases is judged to be less than the predetermined time (step S207: No), the CPU 151 progresses the process to next step S207, and again, judges whether the elapsed time from when the opening degree of the flow rate control valve 202 increases is the predetermined time or more or not.

On the other hand, in step S205, in cases in which the temperature difference ΔTp2 is judged to be set value ΔTs2 or larger (step S205: No), the CPU 151 progresses the process to next step S208.

Next, the CPU 151 increases the opening degree of the flow rate control valve 202 (step S208). By this, the flow rate in the bypass circuit 200B increases, and the temperature difference ΔTp2 decreases. Then the CPU 151 progresses the process to next step S209.

Next, the CPU 151 judges whether an elapsed time from when the opening degree of the flow rate control valve 202 increases is a predetermined time or more or not (step S209). In cases in which the elapsed time from when the opening degree of the flow rate control valve 202 increases is judged to be a predetermined time or more (step S209: Yes), the CPU 151 progresses the process to next step S101 and a measurement is executed again by using the temperature sensor 203. On the other hand, in cases in which the elapsed time from when the opening degree of the flow rate control valve 202 increases is judged to be less than the predetermined time (step S209: No), the CPU 151 progresses the process to next step S209, and again, judges whether the elapsed time from when the opening degree of the flow rate control valve 202 increases is the predetermined time or more or not.

As described above, the bypass circuit 200B of the refrigeration cycle device 200 according to the present Embodiment 2 is provided with the ejector 250 which sucks in and sends out the liquid refrigerant and the lubricating oil retained in the refrigerant-storing container 105. By this, regardless of the positional relationship between the compressor 101 and the refrigerant-storing container 105, the lubricating oil can be favorably returned to the compressor 101, thereby securing a predetermined amount of the lubricating oil in the compressor 101. Scorch of a moving member of the compressor 101 caused by depletion of the lubricating oil can be thus avoided, thereby improving the reliability of the refrigeration cycle device 200. The refrigerant-storing container 105 can be arranged at the same height as or at a height lower than the compressor 101, thereby improving the degree of freedom of the structural design.

In the Embodiment 2, the ejector 250 sucks in the liquid refrigerant and the lubricating oil retained in the refrigerant-storing container 105. For this reason, for example, a power source used for suction of the liquid refrigerant and the lubricating oil can be eliminated different from the conveying pump or the like, thereby reducing the cost needed for the operation of the refrigeration cycle device 200.

The main circuit 200A of the refrigeration cycle device 200 according to the Embodiment 2 is provided with the pressure sensor 201, and the bypass circuit 200B is provided with the temperature sensor 203. This makes it possible to appropriately adjust the flow rate based on the detection results of the pressure sensor 201 and the temperature sensor 203 even in cases in which the flow rate of the fluid mixture flowing through the flow rate control valve 202 is changed. Therefore, even in cases in which the viscosity of the fluid mixture retained in the refrigerant-storing container 105 is high, considerable decrease in the flow rate can be prevented.

For example, in cases in which the relative amount of the lubricating oil in the fluid mixture retained in the refrigerant-storing container 105 is relatively large, the viscosity of the fluid mixture becomes high. When the fluid mixture flows within the bypass circuit 200B, the flow rate of the fluid mixture may considerably decrease due to the friction with the inner circumferential wall of the pipe. In contrast, in the Embodiment 2, the flow rate of the fluid mixture flowing through the flow rate control valve 202 can be appropriately adjusted based on the detection results of the pressure sensor 201 and temperature sensor 203. By this a considerable decrease in the flow rate of the refrigerant flowing within the bypass circuit 200B can be prevented.

Embodiment 3

Next, an air-conditioning device 30 of Embodiment 3 of the present disclosure will be described by using FIG. 9. The same reference signs are used for the same or similar constitution in the above Embodiments, and the description thereof is omitted or simplified. The air-conditioning device 30 according to the Embodiment is different from the air-conditioning device 10 according to Embodiment 1 in that the air-conditioning device 30 is provided with an expander 301 in place of the conveying pump 107 or the like.

Figure 9:
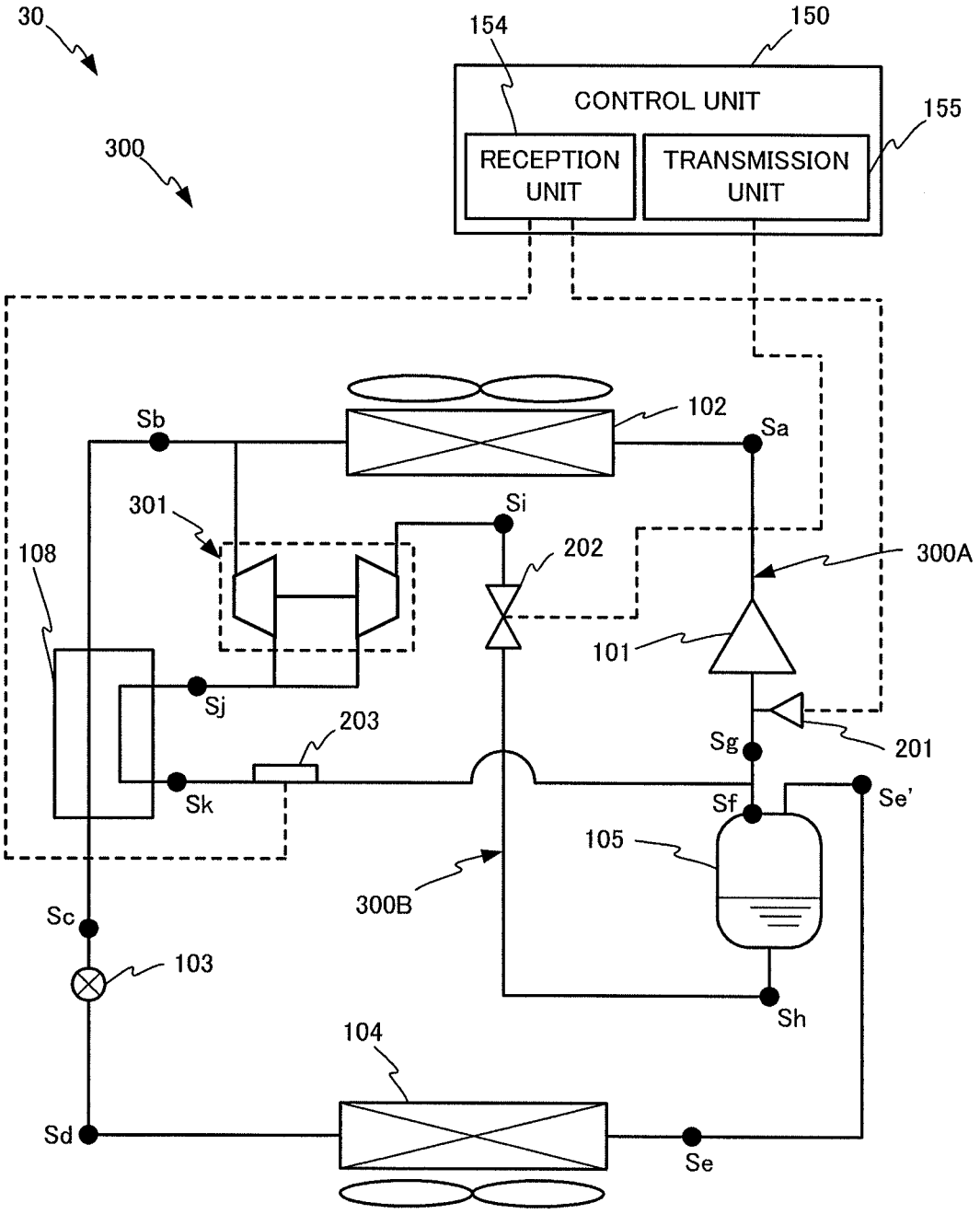
FIG. 9 is a schematic diagram illustrating an air-conditioning device of Embodiment 3.

As illustrated in FIG. 9, the air-conditioning device 30 comprises a refrigeration cycle device 300 including a main circuit 300A and a bypass circuit 300B, and a control unit 150 which controls the refrigeration cycle device 300.

The main circuit 300A comprises the compressor 101, the condenser 102, the expansion valve 103, the evaporator 104, the refrigerant-storing container 105 (accumulator), and the pressure sensor 201 which are described in Embodiment 1 or 2.

The bypass circuit 300B includes the flow rate control valve 202, the temperature sensor 203, and the expander 301. The expander 301 is a device in which the retained liquid refrigerant and the lubricating oil are sucked in by using expansion energy generated when the refrigerant which is sent out from the condenser 102 is expanded. The expander 301 has similar operation to that of the ejector 250 in Embodiment 2.

Specifically, the expander 301 sucks in the fluid mixture in the state Sb which is sent out from the condenser 102 and expands the fluid mixture. Due to expansion energy of the fluid mixture in the state Sb generated at this time, the fluid mixture in the state Si retained at the bottom part of the refrigerant-storing container 105 is sucked in. The fluid mixture in the state Sh changes to the state Si by way of the flow rate control valve 202 and flows into the expander 301. The pressure or the like of the fluid mixture which has flowed into the expander 301 increases, and the fluid mixture changes from the state Si to the state Sj. By this, the fluid mixture in the state Sj is sent out to the internal heat exchanger 108.

As described above, the bypass circuit 300B of the refrigeration cycle device 300 according to the present Embodiment 3 is provided with the expander 301 which sucks in and sends out the liquid refrigerant and the lubricating oil retained in the refrigerant-storing container 105. By this, in a similar manner to Embodiment 1 and 2, regardless of the positional relationship between the compressor 101 and the refrigerant-storing container 105, the lubricating oil can be favorably returned to the compressor 101, thereby securing a predetermined amount of the lubricating oil within the compressor 101. Scorch of a moving member of the compressor 101 caused by depletion of the lubricating oil can be thus avoided, thereby improving the reliability of the refrigeration cycle device 300. The refrigerant-storing container 105 can be arranged at the same height as or at a height lower than the compressor 101, thereby improving the degree of freedom of the structural design.

In the Embodiment 3, the expander 301 sucks in the liquid refrigerant and the lubricating oil retained in the refrigerant-storing container 105. For this reason, for example, a power source used for suction of the liquid refrigerant and the lubricating oil can be eliminated different from the conveying pump or the like, thereby reducing the cost needed for the operation of the refrigeration cycle device 300.

Although Embodiments of the disclosure are described above, the disclosure should not be limited to the above Embodiments or the like.

For example, in the Embodiments 1 to 3, the air-conditioning devices 10, 20, and 30 are provided with the internal heat exchanger 108 as a constitution which vaporizes the liquid refrigerant in the fluid mixture conveyed in the bypass circuit. However, the constitution is not limited to the internal heat exchanger 108 as long as it is a vaporizer which vaporizes the liquid refrigerant, and may be other constitution such as a device which exchanges heat with outside air.

In the above Embodiment, the constitution, the flow chart, or the like can be modified as appropriate.

Although, for example, in the example in FIG. 4, the rotational speed of the refrigerant conveying pump 107 is controlled by the magnitude relationship between the temperature difference $\Delta Tp1$ and the set value $\Delta Ts1$, and in the example in FIG. 8, the opening degree of the flow rate control valve 202 is controlled by the magnitude relationship between the temperature difference $\Delta Tp2$ and the set value $\Delta Ts2$, any method per se for controlling is employed. For example, by using a so-called PID (Proportional Integral Differential) control, the rotational speed of the refrigerant conveying pump 107 or the opening degree of the flow rate control valve 202 may be controlled in accordance with $\alpha\cdot\Delta Tp1+\beta\cdot\int Tp1dt+\gamma\cdot Tp1/dt+\epsilon$, $\alpha\cdot(\Delta Tp1-\Delta Ts1)+\beta\cdot\int(Tp1dt-\Delta Ts1)+\gamma\cdot d(Tp1-\Delta Ts1)/dt+\epsilon$, $\alpha\cdot\Delta Tp2+\beta\cdot\int Ttp2dt+\gamma\cdot dTp2/dt+\epsilon$, and $\alpha\cdot(\Delta Tp2-\Delta Ts2)+\beta\cdot\int(Tp2dt-\Delta Ts2)+\gamma\cdot d(Tp2-\Delta Ts2)/dt+\epsilon$, where $\alpha$, $\beta$, $\gamma$, and $\epsilon$ are any constant or variable.

Figure 10:
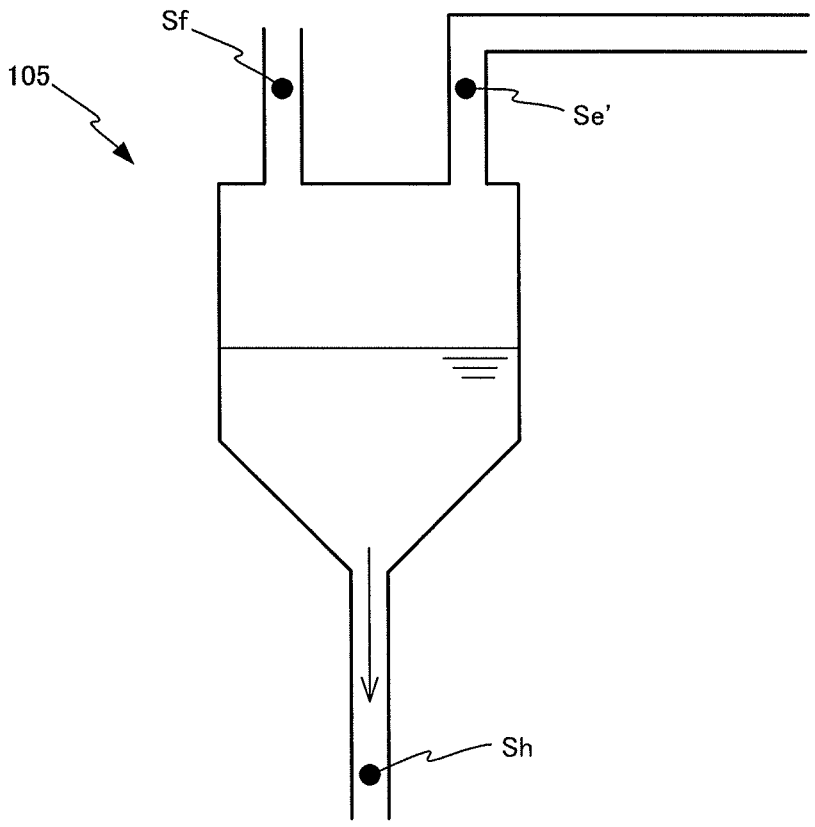
FIG. 10 is a cross section illustrating a modified example of a refrigerant-storing container.

Although, in the Embodiments 1 to 3, the bottom surface of the refrigerant-storing container 105 of the refrigeration cycle device 100, 200, or 300 is constituted as a flat surface, the surface is not limited thereto, and the bottom part of the refrigerant-storing container 105 may be a tapered surface as illustrated in FIG. 10. By this, the liquid refrigerant which is stored in the refrigerant-storing container 105 and the lubricating oil which is mixed within the liquid refrigerant are guided by the cone-shaped tapered surface, which makes it easy to flow. Stable operation of the refrigeration cycle device is thus possible. The bottom part of the refrigerant-storing container 105 may be a mortar shape.

The program used in the above Embodiment may be stored in a recording medium (computer-readable recording medium) such as a flexible disk (magnetic recording disk or the like), a CD-ROM (Compact Disk Read-Only Memory), a DVD (Digital Versatile Disk), or an MO (Magneto-Optical disk), and may be distributable. In this case, by installing the program on a predetermined computer, the above-mentioned process can be executed. The program of the above-mentioned Embodiments may be stored on a storage device (hard disk or the like) on a server provided on a communications network (for example, the Internet or an intranet), and may be downloaded on a local computer by superimposing the program on a carrier wave, or may be readout from the server as needed, and started and executed on a local computer. In cases in which a part of the functions is operated by an OS (Operating System), only other functions which are not operated by the OS may be distributed or transferred.

Examples of using the refrigeration cycle device as the air-conditioning device are described, and the refrigeration cycle device can also be utilized for any other equipment which needs heat exchange. For example, the refrigeration cycle device can be applied to equipment such as water heater or drinking water cooler.

In the present disclosure, a variety of embodiments and modifications are possible without departing from a broad spirit and scope of the disclosure. The above-mentioned Embodiments are only for the purpose of explaining the disclosure, and not fair the purpose of limiting the scope of the disclosure.

INDUSTRIAL APPLICABILITY

The refrigeration cycle device, equipment, and refrigeration cycle method of the disclosure are suitable for controlling the temperature of an object whose temperature is to be controlled.

REFERENCE SIGNS LIST

10, 20, 30 Air-conditioning device
100, 200, 300 Refrigeration cycle device
100A, 200A, 300A Main circuit
100B, 200B, 300B Bypass circuit
101 Compressor
102 Condenser
103 Expansion valve
104 Evaporator
105 Refrigerant-storing container
107 Refrigerant conveying pump (conveying device)
108 Internal heat exchanger (vaporizer)
109*a*, 109*b* Temperature sensor
150 Control unit (control device)
151 CPU
152 Main storage
153 Auxiliary storage
154 Reception unit
155 Transmission unit
156 Bus
201 Pressure sensor
202 Flow rate control valve
201 Temperature sensor
250 Ejector
251 Nozzle portion
251*a* Pressure-reducing portion
251*b* Throat portion
251*c* Widening portion
252 Mixing portion
253 Diffuser portion
254 Inlet portion
255 Suction portion
301 Expander
Tk, Tj Temperature
Tg Saturation temperature
Pb, Pg, Pi, Pz Pressure
ΔTp1, ΔTp2 Temperature difference
ΔTs1, ΔTs2 Set value

The invention claimed is:

1. A refrigeration cycle device comprising:
- a compressor that constitutes a refrigeration cycle and compresses a supplied refrigerant;
- a refrigerant-retaining container that retains a refrigerant into which lubricating oil for the compressor has been mixed, and at the same time, that separates the gas refrigerant from the liquid refrigerant, and that sends out the gas refrigerant to the compressor;
- a conveying device that conveys out a fluid mixture including the liquid refrigerant and the lubricating oil retained within the refrigerant-retaining container;
- a vaporizer that changes the liquid refrigerant in the fluid mixture conveyed out from the refrigerant-retaining container by the conveying device to the gas refrigerant, and provides the compressor with the gas refrigerant together with the lubricating oil, and
- a bypass circuit that interconnects the vaporizer and a refrigerant line interconnecting the refrigerant-retaining container and the compressor, and that supplies the gas refrigerant together with the lubricating oil to the compressor.

2. The refrigeration cycle device according to claim 1, comprising:
- a temperature sensor that measures the temperature of the refrigerant that is sent out from the vaporizer;
- a pressure sensor that measures the pressure of the refrigerant flowing into the compressor; and
- a control device that determines the saturation temperature of the refrigerant flowing into the compressor in accordance with the pressure measured by the pressure sensor, and controls the flow rate of the fluid mixture that the conveying device conveys out from the refrigerant-retaining container in accordance with the difference between the temperature measured by the temperature sensor and the determined saturation temperature.

3. The refrigeration cycle device according to claim 1, wherein the conveying device comprises a conveying pump that conveys liquid.

4. The refrigeration cycle device according to claim 1, wherein the conveying device comprises an ejector that generates the negative pressure by injecting the refrigerant sent out from the compressor from a nozzle portion and sucks in the fluid mixture retained in the refrigerant-retaining container by utilizing the negative pressure.

5. The refrigeration cycle device according to claim 1, wherein the conveying device comprises an expander that sucks in the fluid mixture retained in the refrigerant-retaining container by utilizing expansion energy generated when the refrigerant sent out from the compressor is expanded.

6. The refrigeration cycle device according to claim 4, further comprising a flow rate adjusting valve that adjusts the flow rate of the fluid mixture flowing in the conveying device.

7. The refrigeration cycle device according to claim 1, further comprising:

a condenser that condenses the refrigerant sent out from the compressor;

an expansion valve that expands the refrigerant sent out from the condenser; and an evaporator that evaporates the refrigerant sent out from the expansion valve, wherein the refrigerant-retaining container separates the refrigerant sent out from the evaporator into the gas refrigerant, and the liquid refrigerant and the lubricating oil.

8. The refrigeration cycle device according to claim 1, wherein the vaporizer comprises a heat exchanger that increases the temperature of the fluid mixture that is conveyed by the conveying device by heat exchange with the refrigerant condensed by the condenser.

9. The equipment provided with the refrigeration cycle device according to claim 1.

10. The equipment according to claim 9, comprising an air-conditioning device that conditions the temperature of a space.

11. A refrigeration cycle device comprising:

a compressor that constitutes a refrigeration cycle and compresses a supplied refrigerant;

a refrigerant-retaining container that retains a refrigerant into which lubricating oil for the compressor has been mixed, and at the same time, that separates the gas refrigerant from the liquid refrigerant, and sends out the gas refrigerant to the compressor;

a conveying device that conveys out a fluid mixture including the liquid refrigerant and the lubricating oil retained within the refrigerant-retaining container;

a vaporizer that changes the liquid refrigerant in the fluid mixture conveyed out from the refrigerant-retaining container by the conveying device to the gas refrigerant, and provides the compressor with the gas refrigerant together with the lubricating oil;

an inlet temperature sensor that measures the temperature of the refrigerant flowing into the vaporizer;

an outlet temperature sensor that measures the temperature of the refrigerant that is sent out from the vaporizer; and a control device that controls the flow rate of the fluid mixture that the conveying device conveys out from the refrigerant-retaining container in accordance with the difference between the temperature measured by the outlet temperature sensor and the temperature measured by the inlet temperature sensor.

12. The refrigeration cycle device according to claim 11, further comprising a bypass circuit that interconnects the vaporizer and a refrigerant line, the refrigerant line interconnecting the refrigerant-retaining container and the compressor, wherein the bypass circuit supplies the gas refrigerant together with the lubricating oil to the compressor.

13. A refrigeration cycle method comprising:

a compressing step in which a provided refrigerant is compressed;

a condensing step in which the refrigerant compressed by the compressing step is condensed;

an expanding step in which the refrigerant condensed in the condensing step is expanded;

an evaporating step in which the refrigerant expanded by the expanding step is evaporated;

a refrigerant retaining step in which the refrigerant evaporated in the evaporating step is separated into the gas refrigerant, and the liquid refrigerant and lubricating oil, and the gas refrigerant is sent out to a compressor, and the liquid refrigerant is retained together with the lubricating oil;

a conveying step in which the liquid refrigerant retained in the refrigerant retaining step is conveyed out; and a vaporizing step in which the liquid refrigerant conveyed out from a refrigerant-retaining container by the conveying step is changed to the gas refrigerant to be subjected to compression by the compressing step, and a supplying step in which the gas refrigerant together with the lubricating oil are supplied through a bypass circuit to the compressor, the bypass circuit interconnects the vaporizer and a refrigerant line that interconnects the refrigerant-retaining container and the compressor.

14. The refrigeration cycle method according to claim 13, further comprising a measuring step in which the temperature of the refrigerant flowing into the vaporizer is measured as an inlet refrigerant temperature, a measuring step in which the temperature of the refrigerant that is sent out from the vaporizer is measured as an outlet refrigerant temperature, a calculating step in which the difference between the inlet refrigerant temperature and the outlet refrigerant temperature is calculated, and a controlling step in which the flow rate of the fluid mixture that is, in the conveying step, conveyed out from the refrigerant-retaining container is controlled in accordance with the difference between the inlet refrigerant temperature and the outlet refrigerant temperature measured in the measuring step.

15. The refrigeration cycle method according to claim 13, further comprising a temperature measuring step in which the temperature of the refrigerant that is sent out from the vaporizer is measured as an outlet refrigerant temperature, a pressure measuring step in which the pressure of the refrigerant that flows into the compressor is measures as an inlet refrigerant pressure, a determination step in which a saturation temperature of the refrigerant flowing into the compressor is determined in accordance with the inlet refrigerant pressure as measured in the pressure measuring step, and a controlling step in which the flow rate of the fluid mixture that is, in the conveying step, conveyed out from the refrigerant-retaining container is controlled in accordance with the difference between the outlet refrigerant temperature and the saturation temperature determined in the determination step.

* * * * *